US007866101B2

(12) United States Patent
Boggs, Jr.

(10) Patent No.: US 7,866,101 B2
(45) Date of Patent: Jan. 11, 2011

(54) INFLATABLE PROTECTIVE HOME BARRIER

(76) Inventor: Patrick H. Boggs, Jr., 3213 Milford Ave., Baltimore, MD (US) 21207

( * ) Notice: Subject to any disclaimer, the term of this patent is extended or adjusted under 35 U.S.C. 154(b) by 1048 days.

(21) Appl. No.: 11/451,386

(22) Filed: Jun. 13, 2006

(65) Prior Publication Data

US 2006/0277830 A1 Dec. 14, 2006

Related U.S. Application Data

(60) Provisional application No. 60/690,423, filed on Jun. 14, 2005.

(51) Int. Cl.
*E04H 15/20* (2006.01)
*E04D 1/34* (2006.01)

(52) U.S. Cl. ..... 52/202; 52/2.11; 52/2.25; 52/4

(58) Field of Classification Search ..... 52/2.11, 52/2.24, 2.25, 4, DIG. 14, 202
See application file for complete search history.

(56) References Cited

U.S. PATENT DOCUMENTS

| | | | | | |
|---|---|---|---|---|---|
| 2,028,060 | A | * | 1/1936 | Gilbert | 47/32.5 |
| 3,008,214 | A | * | 11/1961 | Foster et al. | 428/12 |
| 3,332,177 | A | * | 7/1967 | Sepp | 52/2.19 |
| 3,548,904 | A | * | 12/1970 | Mackell | 53/473 |
| 4,672,888 | A | * | 6/1987 | Crombie et al. | 454/254 |
| 4,858,395 | A | | 8/1989 | McQuirk | |
| 5,263,543 | A | * | 11/1993 | Nigro | 169/56 |
| 5,423,150 | A | | 6/1995 | Hitchcock | |
| 5,566,512 | A | * | 10/1996 | Page | 52/2.16 |
| 5,608,992 | A | | 3/1997 | Floyd | |
| 5,630,296 | A | * | 5/1997 | Kendall, Jr. | 52/2.11 |
| 5,710,543 | A | * | 1/1998 | Moore | 340/691.7 |
| 5,748,072 | A | | 5/1998 | Wang | |
| 5,829,200 | A | | 11/1998 | Jones et al. | |
| 5,860,251 | A | | 1/1999 | Gleich | |
| 5,944,114 | A | | 8/1999 | Farley | |
| 6,125,941 | A | | 10/2000 | Lokken | |
| 6,192,633 | B1 | * | 2/2001 | Hilbert | 52/2.18 |
| 6,266,926 | B1 | * | 7/2001 | Figge et al. | 52/1 |
| 6,695,068 | B2 | * | 2/2004 | Woodall et al. | 169/47 |
| 6,708,451 | B1 | * | 3/2004 | Gomes | 52/2.17 |
| 7,464,506 | B2 | * | 12/2008 | Atkinson | 52/202 |
| 2006/0059788 | A1 | * | 3/2006 | Kassianoff | 52/2.11 |
| 2006/0260226 | A1 | * | 11/2006 | Gower | 52/202 |
| 2007/0000188 | A1 | * | 1/2007 | Smushkovich | 52/167.1 |
| 2007/0220817 | A1 | * | 9/2007 | Bonds | 52/202 |

* cited by examiner

*Primary Examiner*—Richard E Chilcot, Jr.
*Assistant Examiner*—Elizabeth A Plummer
(74) *Attorney, Agent, or Firm*—Ober, Kaler, Grimes & Shriver; Royal W. Craig

(57) ABSTRACT

A fire protection system for homes and other structures including a pliable multi-layered shroud of fire-resistant material having an inflatable support structure embedded therein. The inflatable support structure includes a web of inflatable channels for rapid deployment from a folded configuration to an inflated configuration in which the fire-resistant material partially envelops a structure. The shroud is packed in an enclosure having a bi-fold top panel for ease of access. The enclosure also has one or more air hose couplings to which the inflatable support structure is connected for rapid inflation and deployment out of the enclosure. A plurality of tethers are also provided as tie-downs, which anchor the heat resistant shroud. The system affords ample rapid deployment protection from neighboring fires and heat exposure therefrom.

5 Claims, 10 Drawing Sheets

INFLATABLE PROTECTIVE HOME BARRIER

CROSS-REFERENCE TO RELATED APPLICATION

The present application derives priority from provisional patent application No. 60/690,423 filed Jun. 14, 2005.

BACKGROUND OF THE INVENTION

1. Field of the Invention

The present invention generally relates to fire protection systems, and specifically to a fire protection system including a barrier that deploys from a modular kit and rapidly inflates to form a large barrier to provide a whole-house protection for residential dwellings in case of wildfire or provide heat exposure protection from a next door house or structure fire.

2. Description of the Background

Volunteer fire companies and municipal fire departments are largely responsible for putting out fires whenever they occur in any community that they serve. However, there are many rural towns, especially in dry areas, where service is not practicable. In such areas there is a great risk of forest fires spreading from home to home. Consequently, as a practical matter for those who live in the back country, fire fighting is left up to the individual property owners. For small fires extinguishers work well, but for larger fires they are simply inadequate. The typical approach to saving one's house from a full scale spreading fire is to pre-wet the house with hose-water. Statistically, this level of effort is miniscule and is often unsuccessful. Even if successful in preventing spread, there is still a significant risk of structural damage resulting from heat exposure due to the neighboring fire.

Thus, there remains a need for a device to help private home owners protect their homes from spreading wildfires when they are not adequately served by volunteer fire companies or municipal fire departments.

Past efforts at accomplishing the foregoing include U.S. Pat. No. 6,125,941 to Lokken, which discloses a wettable polymer blanket for protecting items from fire, including houses and mobile homes.

U.S. Pat. No. 5,944,114 to Farley discloses a number of devices for constraining wildfires. One device comprises a fire-resistant sheet which may be draped over trees or structures or may be put on the ground to form a barrier to the fire. A plurality of these devices may be aligned at the perimeter of a fire to establish a barrier.

U.S. Pat. No. 5,860,251 to Gleich discloses a fire-resistant flexible dome apparatus for covering and protecting buildings, goods, livestock, persons and other objects from a fire, especially wildfires. The apparatus is rapidly deployed from a container, preferably located on the roof of the building to be protected.

U.S. Pat. No. 5,829,200 to Jones et al. and U.S. Pat. No. 4,858,395 to McQuirk disclose fire retardant blankets stowed on a building roof structure, with cables that extract the blankets for deployment over the structure.

U.S. Pat. No. 5,748,072 to Wang and U.S. Pat. No. 5,423,482 to Hitchcock disclose automatic systems for protecting a house or a building from fire. A computer detects a fire and automatically unfolds a fire protecting cover to isolate a house from the outside.

Similarly, U.S. Pat. No. 5,608,992 to Floyd discloses a fire isolation tarp for a free standing structure.

Unfortunately, the foregoing and other known prior art devices are not fully capable of rapid deployment over a home or building when confronted with an approaching wildfire, or are relatively bulky, permanent installations that are inconvenient to use, nor flexible enough to be used by the fire department to provide heat exposure protection from the random next door house fire.

There remains a need for a pre-engineered, pre-fabricated, portable, modular wildfire protection system that inflates from a compact footprint to a full-scale barrier for rapid deployment by a single person or firemen.

SUMMARY OF THE INVENTION

It is therefore an object of the present invention to provide a system for protecting residential houses or buildings from a wildfire or any neighboring fire in a proximate area.

It is another object to provide an inflatable fire-resistant fabric structure that is rapidly deployed over a home or building when confronted with an approaching fire, yet which remains fully attached durable despite harsh wind and fire conditions.

It is an additional object of this invention to provide a convenient storage and deployment apparatus for the protective device.

It is yet another object of this invention to provide for rapid deployment of the protective device by a single person.

Still another object of the present invention is to provide an inflatable structure that can serve as a support for a larger sheet, which acts a shield from a wildfire or any neighboring fire in a proximate area.

Yet another object of the present invention is to provide an inflatable structure that serves as an inflatable billboard for advertising or displaying designs, pictures, etc.

The foregoing and other objects are accomplished by a fire protection system for homes and other structures. The system is primarily composed of a pliable, flexible, multi-layered shroud of fire resistant material with an inflatable support structure embedded therein for deploying the sheet to partially envelope a structure if a wildfire approaches (e.g. protection against cinders, ashes, burning objects such as tree limbs), or from neighboring fires. The shroud of fire resistant material is folded and enclosed in a portable knock-down wheeled enclosure for ease of maneuvering, and air hoses as necessary for inflation are coupled directly to the enclosure.

In use, the system is ported to the structure to be protected, and a remote air source is coupled to the enclosure. The air is turned on, thereby inflating the support structure and suspending the shroud of fire resistant material over the structure to be protected. The shroud is then tethered to the structure, and the air is evacuated such that the shroud deflates and lays flat over the structure, thereby affording ample protection from fires. Additionally, the system may comprise a large sheet attached to the top of the inflatable structure whereby the sheet acts as a protective shield. In this manner the system can be rapidly deployed over a home or building when confronted with an approaching fire, yet remains fully attached in its deflated condition durable despite harsh wind and fire conditions. Afterward, the shroud may easily be re-inflated, un-tethered, repacked and re-used.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention is a system for protecting residential houses or buildings from a wildfire or any neighboring fire in a proximate area by rapid deployment of an inflatable structure supporting a fire-resistant fabric covering that expands to substantially enshroud a home or building when confronted with an approaching fire. The inflatable structure is deployed out of a storage case by administering pressurized air to the storage case. The inflatable structures are modular, allowing use of a plurality of same in an overlapping manner to protect larger structures.

Figure 1:
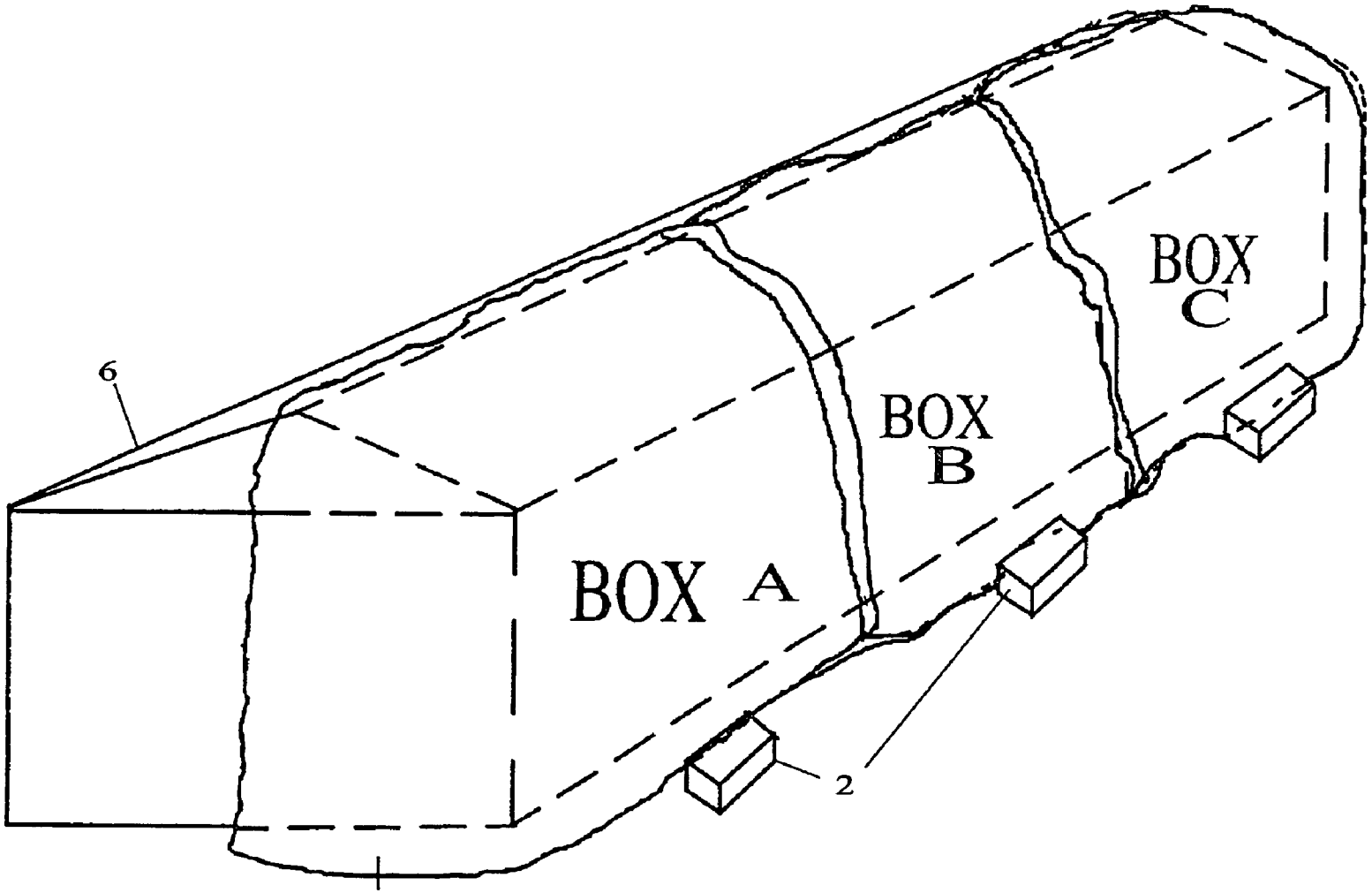
FIG. 1 is a perspective view of the system for protecting residential houses according to the present invention.

FIG. 1 is a perspective view of the system for protecting residential houses according to the present invention, which operates by rapid inflatable deployment of an inflatable structure including a fire-resistant fabric shroud 4 that expands by inflation to form a box-shield that substantially covers at least one side of a home or building 6 when confronted with an approaching fire. Each inflatable structure is deployed out of a storage case 2 by administering pressurized air directly to the storage case 2. The inflatable structures are modular, allowing use of a plurality of same in an overlapping manner (as shown) to protect larger structures. In addition to or instead of providing fire protection, the inflatable structure can serve as an inflatable billboard displaying advertisements, designs, pictures, event information, messages, etc.

Figure 2:
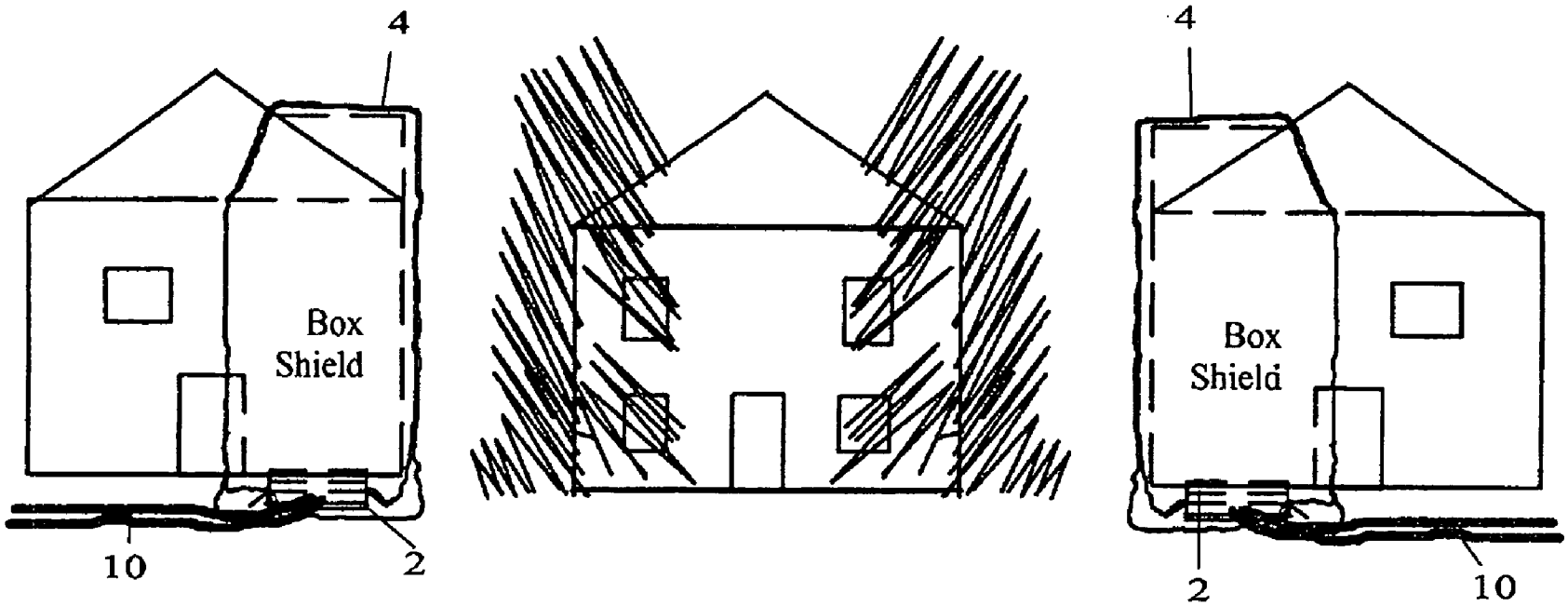
FIG. 2 is a perspective view of two opposing fire and heat-resistant fabric shrouds 4 fully deployed on both sides of a house fire to form opposing box-shields that substantially protect both neighboring homes 6 from the intermediate fire.

FIG. 2 is a perspective view of two opposing fire-resistant fabric shrouds 4 fully deployed on both sides of a house fire to form opposing box-shields that substantially protect both neighboring homes 6 from the intermediate fire. Again, the respective inflatable fabric shrouds 4 are deployed directly out of their respective storage cases 2 by administering pressurized air directly to the storage cases 2 by air hoses 10 which may be coupled to conventional compressors or pressurized air storage cylinders.

Figure 3:
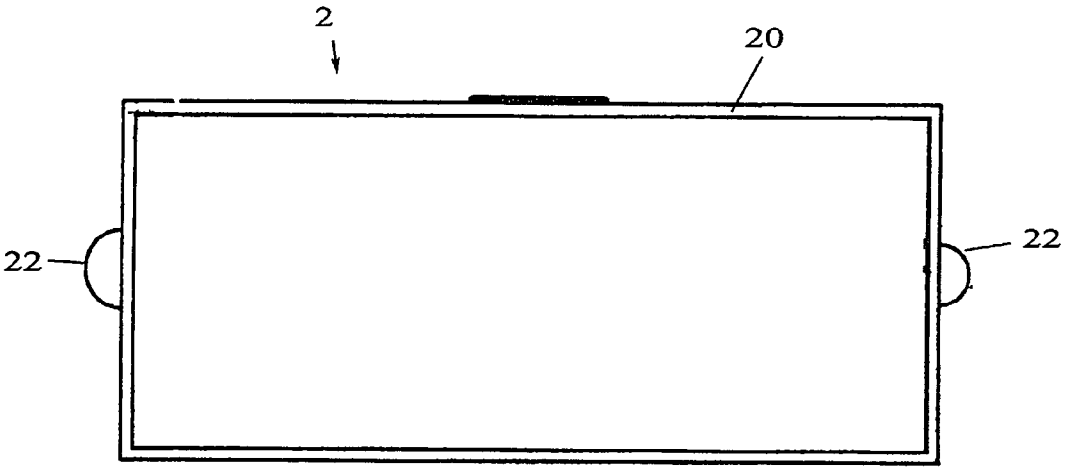
FIGS. 3-5 are a top, end and back side view, respectively of an exemplary storage case 2 as in FIGS. 1-2.
Figure 5:
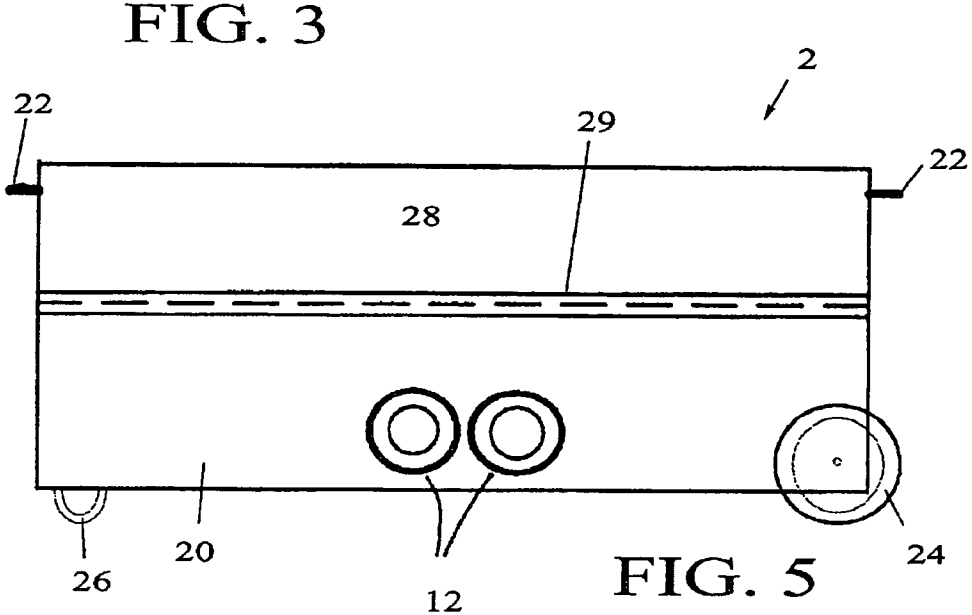
Figure 4:
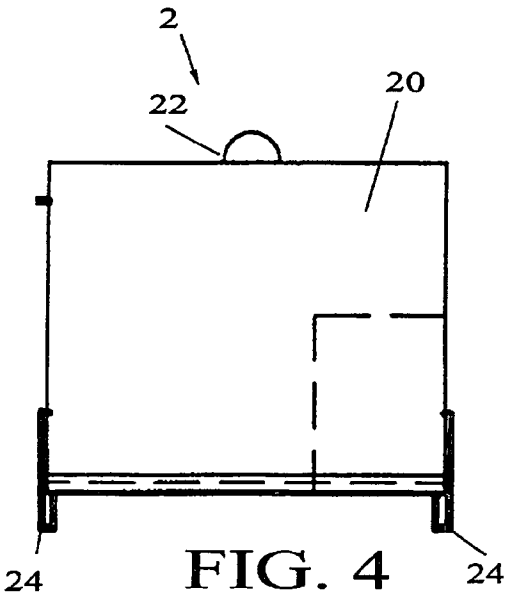

FIGS. 3-5 are a top, end and back side view, respectively of an exemplary storage case 2 as in FIGS. 1-2. Storage case 2 generally comprises a six-walled elongate rectangular enclosure 20 having centrally disposed end and top handles 22 for ease of grasping. The storage case 2 includes two end-mounted wheels 24 for maneuvering by use of handles 22 similar to wheeled luggage. Two side-mounted air couplings 12 are provided for coupling high-compression air hoses, one for inflation and one for deflation. An optional additional set of hose couplings may be provided for circulating cooling fluid, if desired. Couplings 12 may be conventional panel-mount quick-connect/disconnect couplings for attachment of standard pneumatic hoses. The storage case 2 may be opened completely by unfolding a hinged bi-fold top panel 28, which is pivoted to the storage case 2 along hinge 29. In addition, front and side panels may be pivoted down to lay the entire storage case 2 open and flat.

Figure 6:
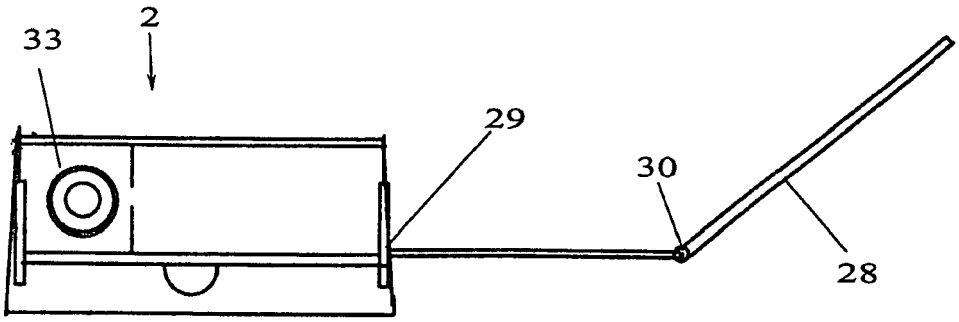
FIGS. 6-7 are a side end and top view, respectively of the storage case 2 as in FIGS. 3-5 with bi-fold top panel 28 unfolded, and side panels 31, 32 and front panel 33 unfolded for ready access to the internal fire-resistant fabric shroud 4 therein.
Figure 7:
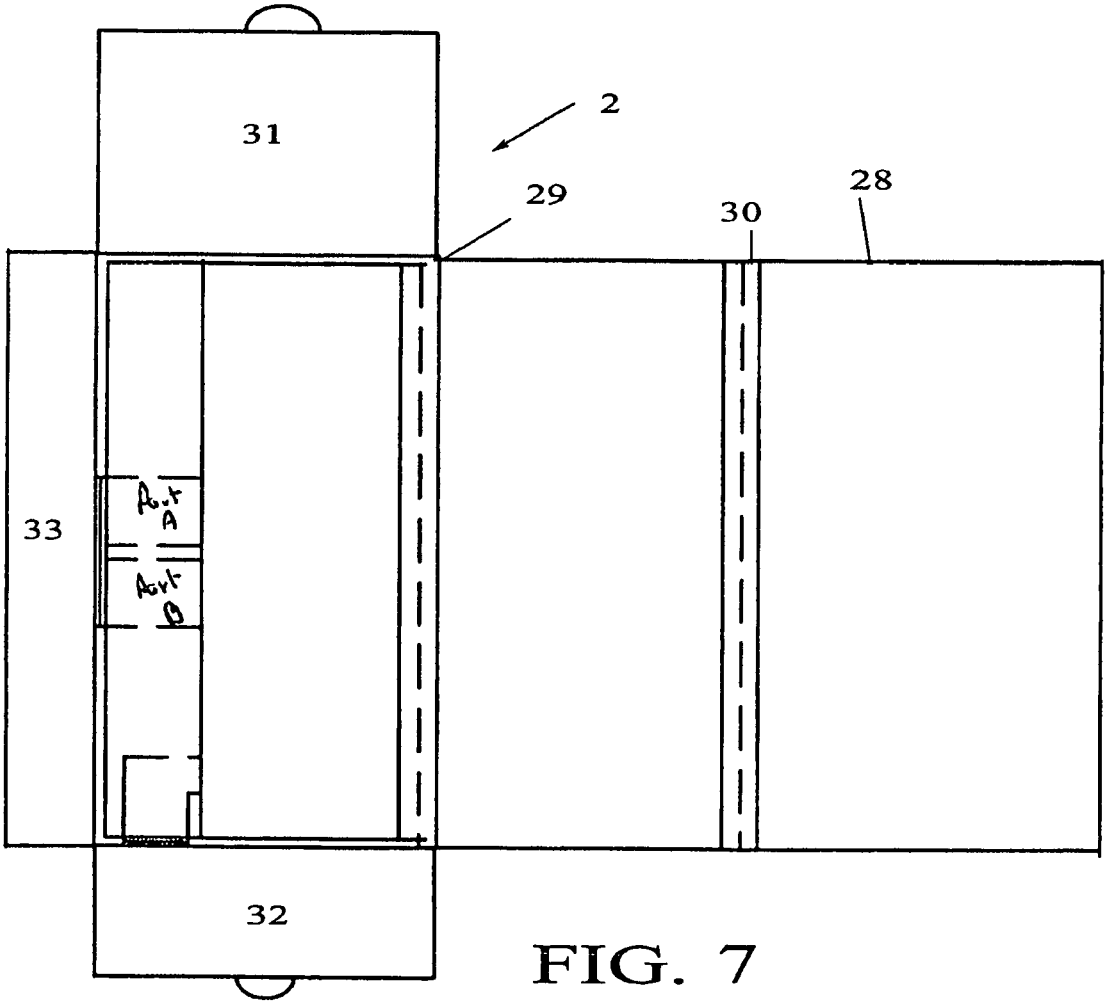

FIGS. 6-7 are a side end and top view, respectively of the storage case 2 as in FIGS. 3-5 with bi-fold top panel 28 unfolded, and side panels 31, 32 and front panel 33 unfolded for ready access to the internal fire-resistant fabric shroud 4 therein. An additional fluid hose coupling 33 is shown in FIG. 6 for circulating cooling fluid. Upon deployment, the entire storage case 2 folds down to lay it open and flat. The fire-resistant fabric shroud 4 is folded for storage resident in the storage case 2.

Figure 9:
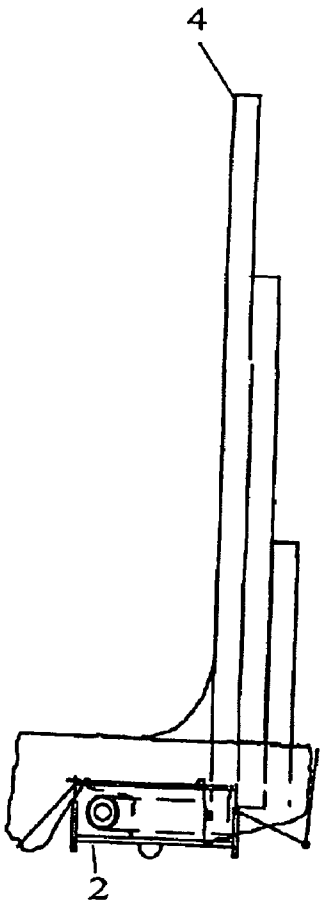
FIGS. 8 and 9 are a top and side view of the system for protecting residential houses with fire-resistant fabric shroud 4 unfolded out of the storage case 2, but not yet fully inflated.
Figure 8:
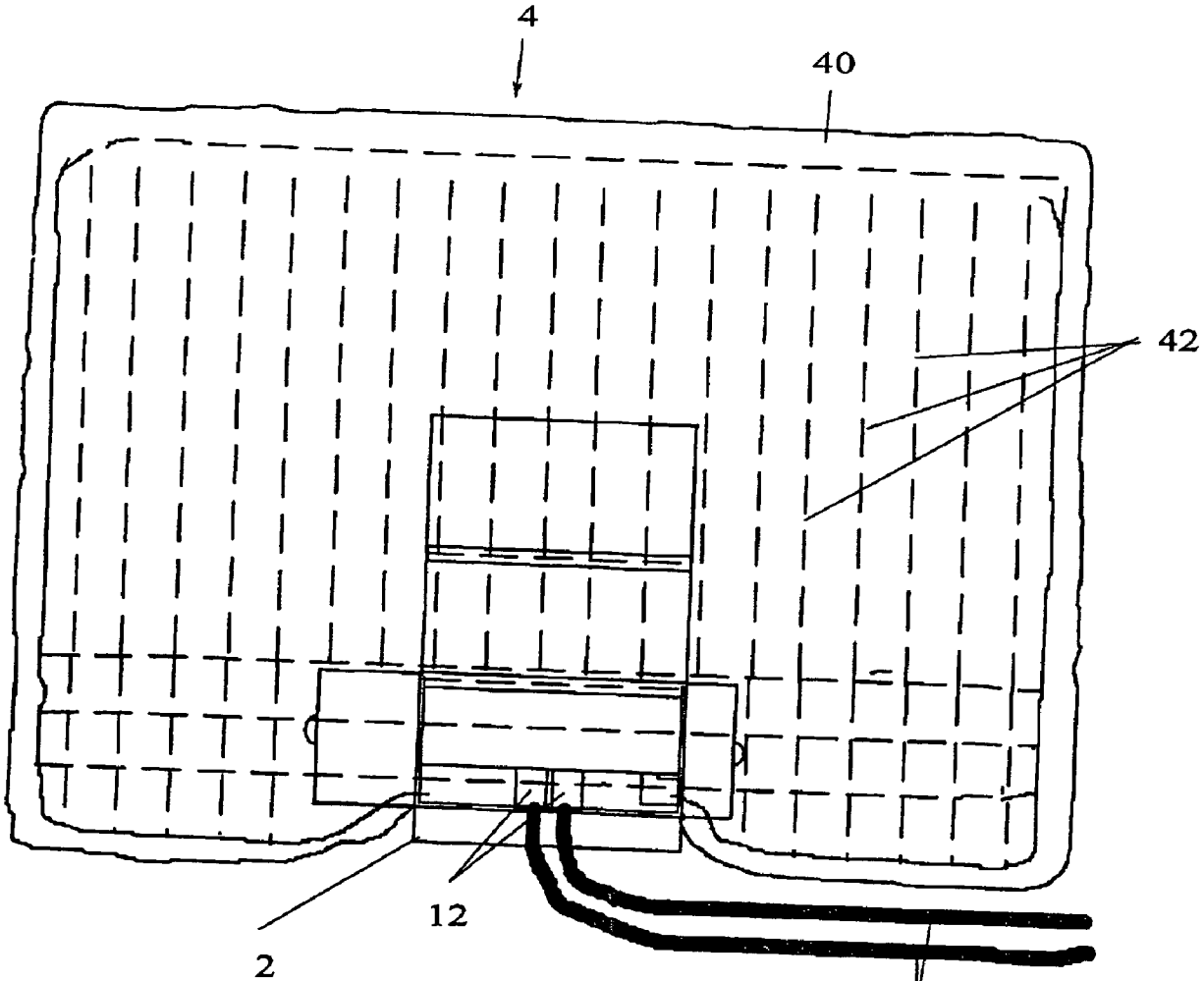

FIGS. 8 and 9 are a top and side view of the system for protecting residential houses with fire-resistant fabric shroud 4 unfolded out of the storage case 2, but not yet fully inflated. The fire-resistant fabric shroud 4 generally comprises an approximately 40' by 40' rectangular panel having inflatable air baffles sewn therein. A primary air baffle 40 runs around the perimeter of fire-resistant fabric shroud 4 for main support, and the extent of the fabric shroud 4 is traversed by a matrix of secondary air baffles 42 for secondary support.

The fabric of the fire-resistant fabric shroud 4 is preferably a pliable, flexible 2 multi-ply layered sheet of fire-resistant carbon cloth or other various Siltemp™ fabrics that are commercially available from Ametek Inc. The air baffles 40, 42 may be PVC or Hypalon fabric heat-welded or sewn to form the air channels (in a known manner similar to inflatable boats and furniture) and sewn between the sheet layers of fire and heat-resistant cloth or Siltemp fabric. The fabric of the fire-resistant fabric shroud 4 is fixedly attached along the front of the storage case 2 (as shown), and the air baffles 40, 42 are in direct fluid communication with the couplings 12 for filling or evacuation through hoses 10. Additionally, a large fire-resistant sheet (not shown) can be attached at the top of the fire-resistant shroud 4 whereby the shroud 4 acts as a support for the fire-resistant sheet which shields the entire structure, providing additional protection from neighboring fires and heat exposure therefrom. The fire-resistant sheet and shroud 4 can be attached with hook and loop fasteners (e.g. Velcro®) or any other suitable attachment means. The dimensions of the fire-resistant sheet are approximately ⅔ greater that the shroud 4 in width and length, thus allowing the sheet to cover a larger area. The fire-resistant sheet can be cut into different shapes and sizes to fit over the specific structure to be covered. Also, the fire-resistant sheet can be made of fire-resistant carbon cloth or other various Siltemp™ fabrics that are commercially available from Ametek Inc.

Also provided in the storage case 2 are a plurality of conventional tether attachments (not shown) to secure the storage case 2 to the house, and to secure the fire and heat-resistant fabric shroud 4 to the roof and/or walls of the house.

In use, the above-described system may be employed by the Fire Department, or by the homeowner.

FIGS. 10-13 are a sequence of drawings showing the set-up and operation of the present system.

Figure 10:
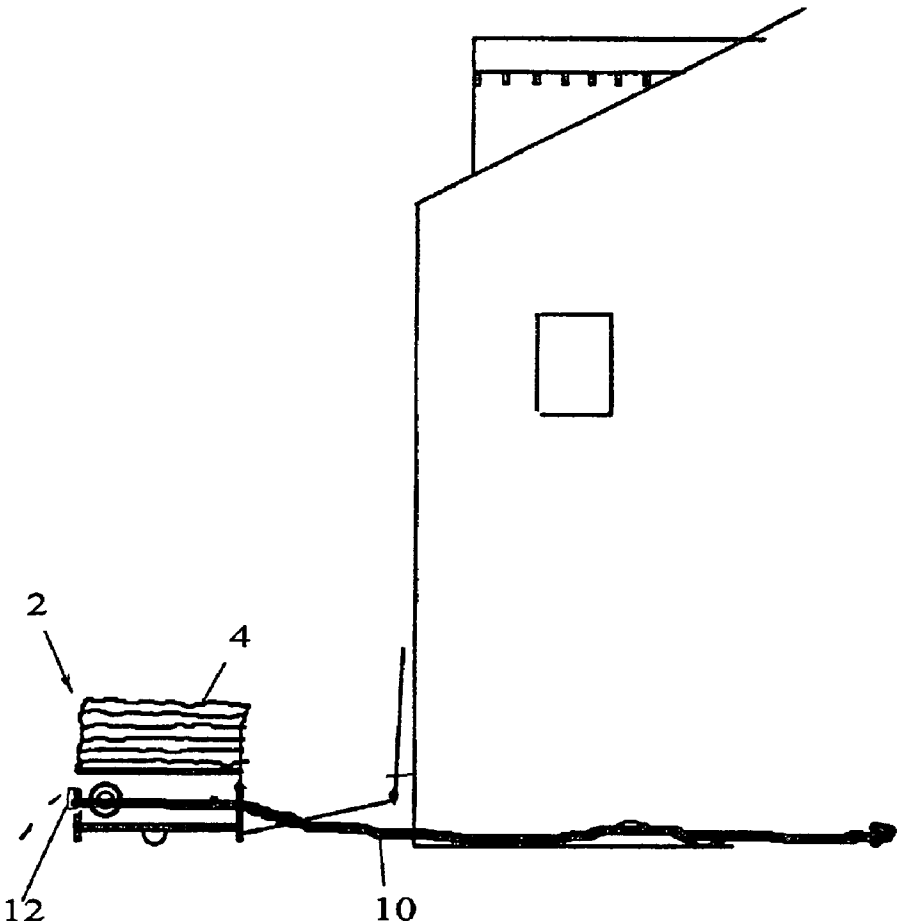
FIGS. 10-13 are a sequence of drawings showing the set-up and operation of the present system.

In operation, and as seen in FIG. 10, the storage case 2 with fire-resistant fabric shroud 4 folded therein is placed next to the structure to be protected for rapid deployment by compressed gasses, and the fire-resistant fabric shroud 4 is exposed by folding down the hinged panels. High pressure air hoses 10 are connected between the respective air input and evacuation couplings 12 at the rear of the storage case, and to a compressor or compressed air cylinder and evacuation pump as desired.

Figure 11:
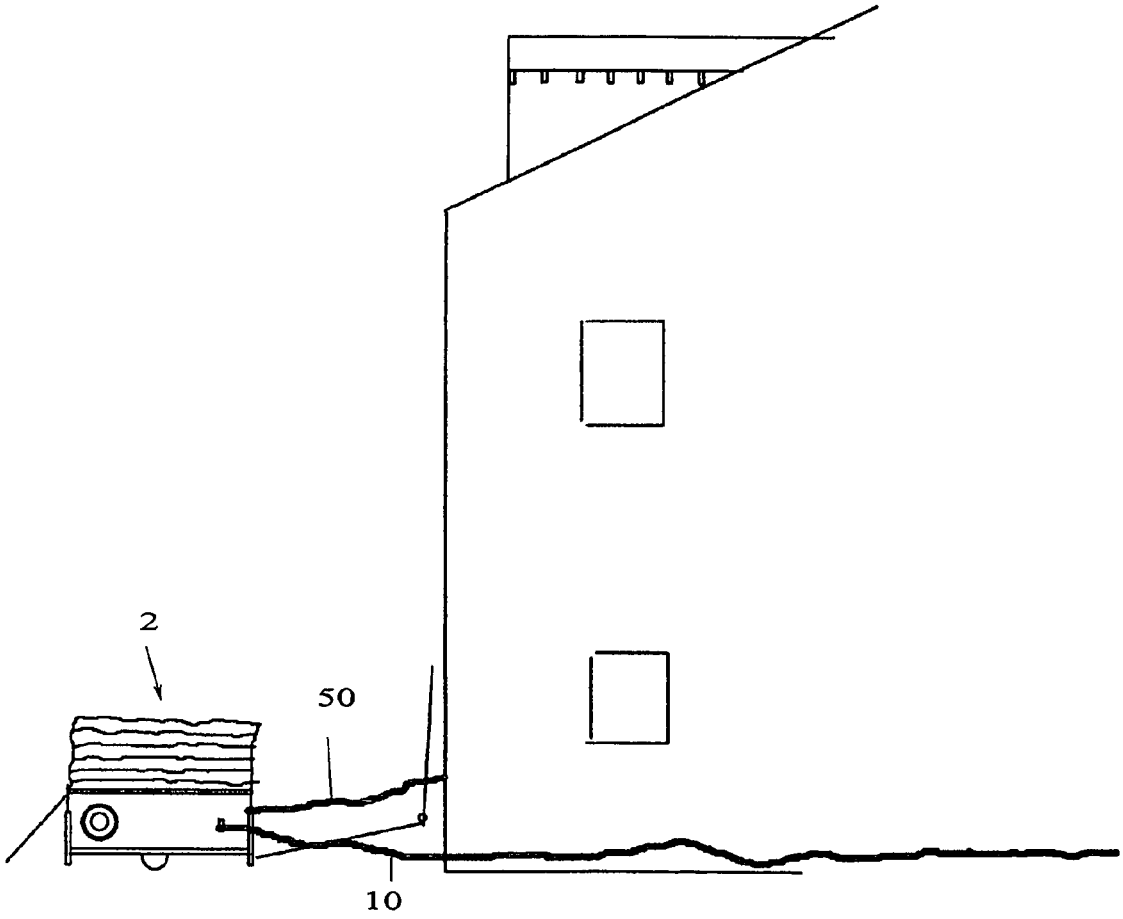

As seen in FIG. 11, the storage case 2 is anchored in place by tethers 50 which are attached on both sides of the storage case 2 to the structure during inflation.

Figure 12:
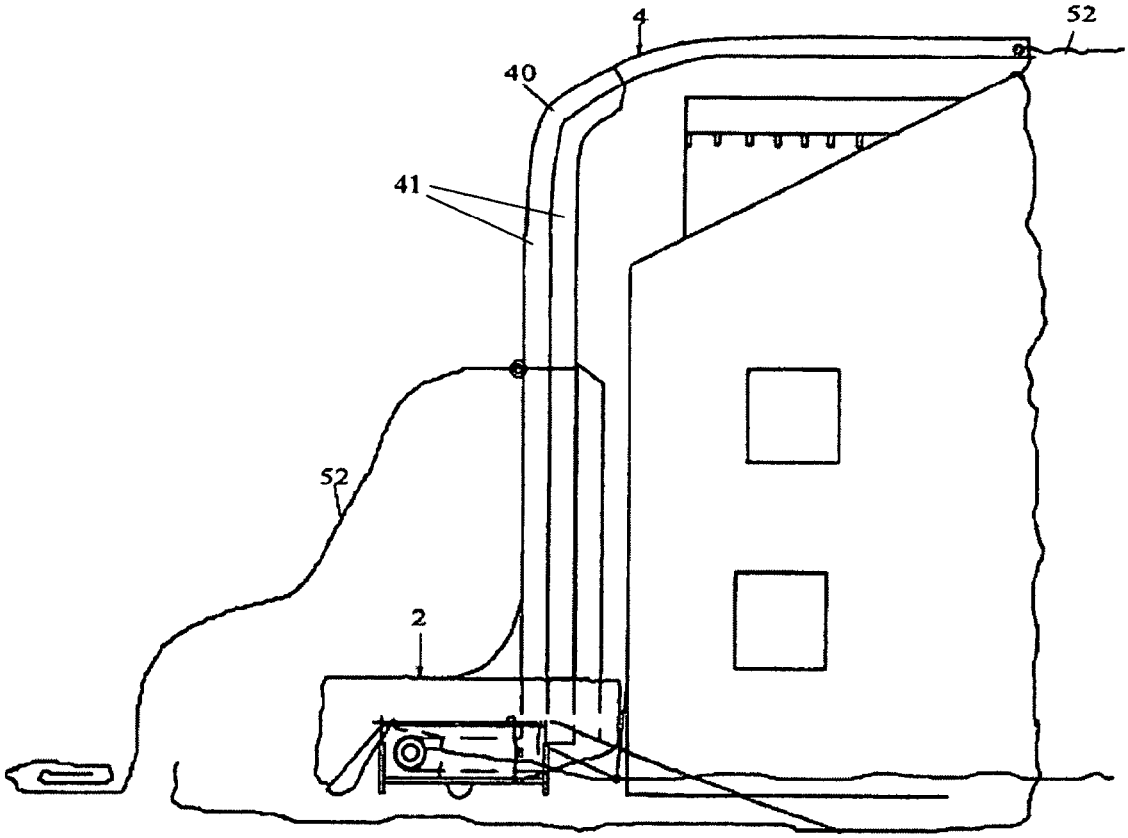

As seen in FIG. 12, the air supply is turned on causing compressed gasses to be forced into the bladders 41 between the layers of fabric of the fire-resistant fabric shroud 4 (beneath the fire resistant material). The compressed gasses cause the bladders 41 to inflate automatically and take the shape of a rectangular panel under the influence of the baffles 40, 42, pushing the fabric shroud 4 out of the enclosure 2. The compressed gasses will inflate the lower supporting structure of the shroud 4 first, creating a foundation to hold the upward expanding folds of fire-resistant fabric shroud 4. The upper portion inflates last, completing an upward deployment that partially cover the side and the roof of the structure to be protected. When complete deployment is achieved, additional tethers 52 are attached on each inflated end of the top of the fabric shroud 4, and these are secured and tightened to center the inflated fabric shroud 4 over the structure.

Figure 13:
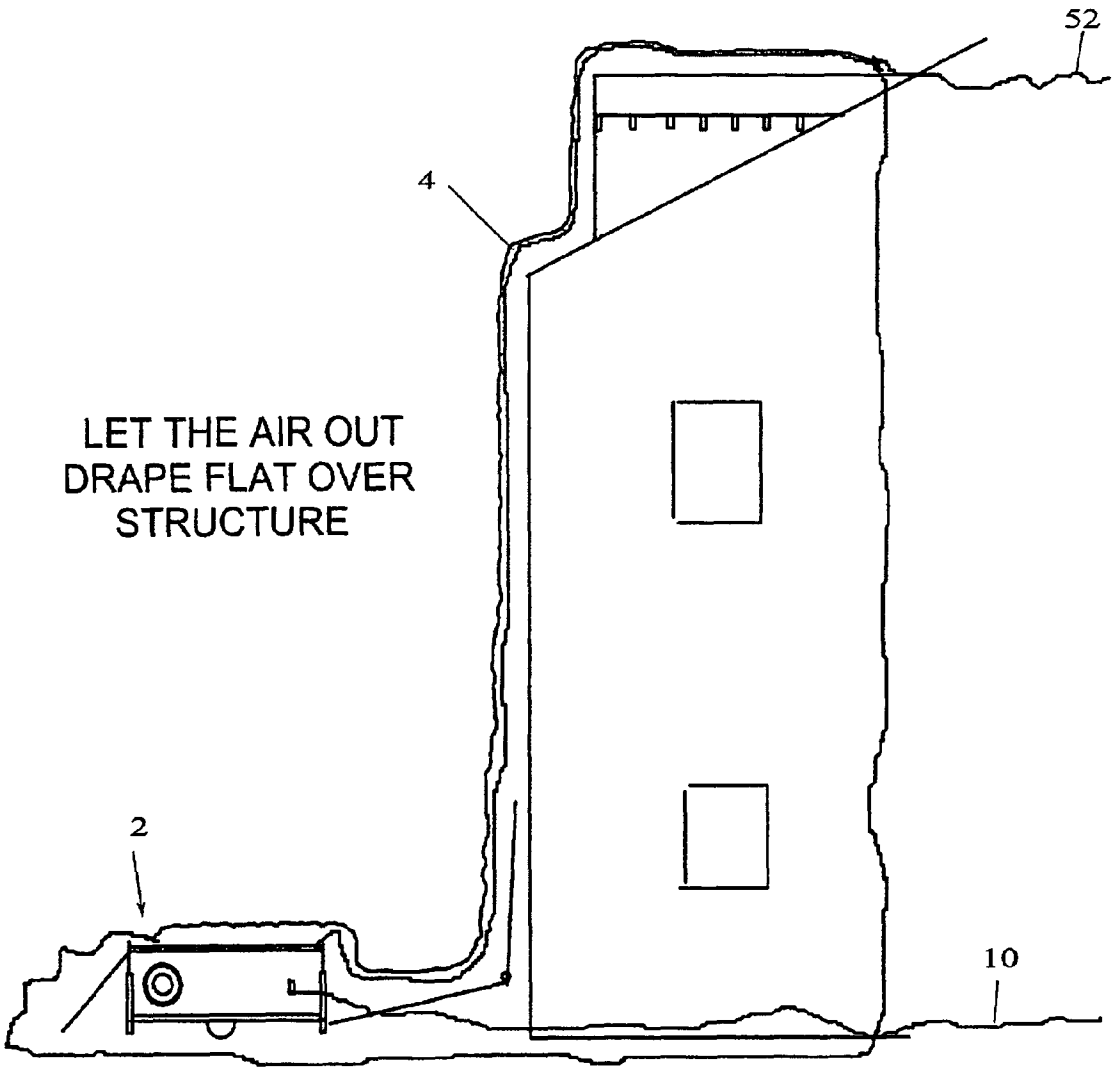

As seen in FIG. 13, the compressed gasses are then evacuated through evacuation coupling 12, thereby removing the extended fabric shroud 4 structural support. The fabric shroud 4 drapes loosely down over the end and roof of the structure, held thereon by tethers 52. The tethers 52 may be retightened to complete the installation. The above-described system can be deployed in approximately ten minutes. After complete deployment the protective home barrier system partially envelops the entire side and roof of the structure, protecting it from the various forms of heat exposure damage. After the fire danger has passed the barrier is recovered by re-inflating it, removing the tethers 50, 52, and reversing the airflow to evacuate the remaining gases, thereby shrinking the barrier in size. The fabric shroud 4 can easily be folded and repacked into the enclosure 2 for reuse at the next house fire or wildfire.

Moreover, referring back to FIG. 1, multiple modular systems may be deployed and the extended fabric shrouds 4 overlapped side-by-side to accommodate larger buildings or houses. The modular overlapping configuration of the foregoing system is well-suited for protecting many different sizes and shapes of structures. The present modular configuration is designed to attach to and overlap with other modules 2 to form a complete fire protection system able to adapt to just about any size and style of house.

Figure 14:
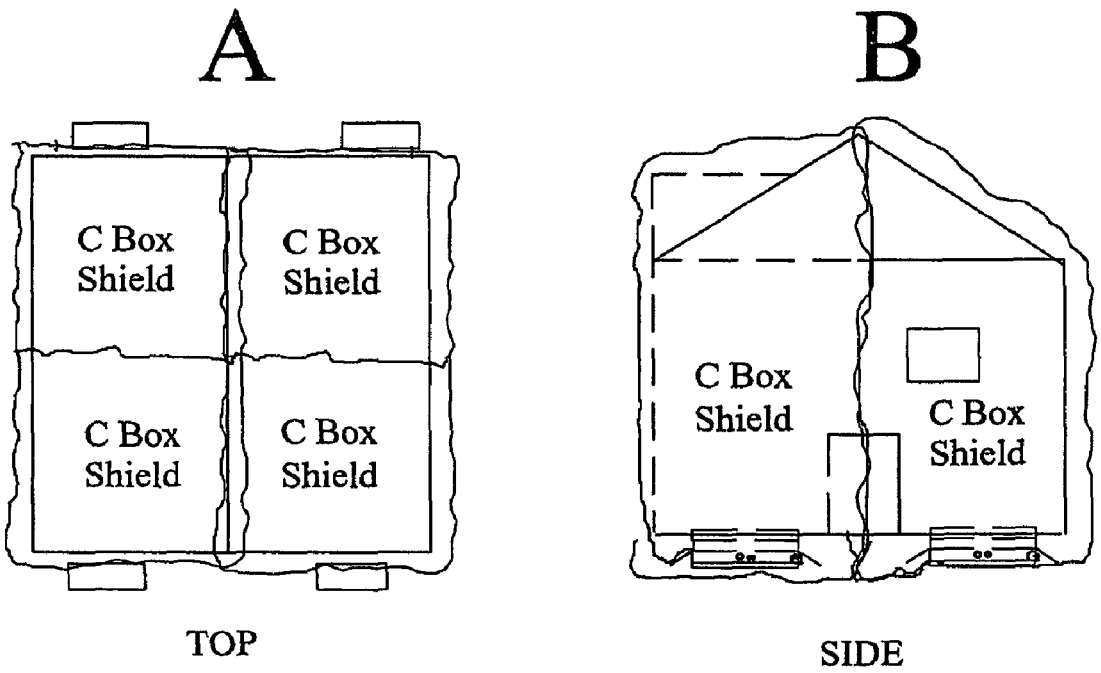
FIGS. 14A-B are top and side views of a house protected by four overlapping modules 2.

FIGS. 14 (A & B) are top and side views, respectively of a house protected by four overlapping modules 2. Additionally, for example, a house trailer may be adequately protected by two modules 2 overlapping on the sides, a rancher may use 2-to-4 modules overlapping the end corners and roof, and a two story cottage may use three to four modules 2 overlapping the corners and mid section. Larger structures with sun rooms or extensions would be protected with additional modules 2 overlapping as needed for complete protection. Each modular unit is packed into its own enclosure 2, and if desired the enclosures 2 may be color-coded or otherwise marked to identifying which pre-formed module 2 it is (for example, T for trailers, R for Rancher, C for Cottage, M for mid-section, I for inside corner, O for outside corner, etc).

Having now fully set forth the preferred embodiments and certain modifications of the concept underlying the present invention, various other embodiments as well as certain variations and modifications thereto may obviously occur to those skilled in the art upon becoming familiar with the underlying concept. For example, the concept can be modified into smaller dedicated modules for busses, tractor trailers and airplanes. The design may easily be supplemented to provide temperature control of sensitive structures also to include LAP gas and Propane tanks. This is accomplished by incorporating additional channels in the fabric shrouds 4 with patterns of openings on the underside to allow inert gasses such as liquid nitrogen or liquid carbon dioxide to be pumped between the inside of the shield 4 and the sensitive structure, thereby maintaining safe temperature levels. Deployment and recovery would be the same as described above. The design may easily be supplemented with the fire-resistant fabric on the inside along with the same structure for temperature control where liquid nitrogen, liquid carbon dioxide or foam can be pumped into a structure to put out a fire.

It is to be understood, therefore, that the invention may be practiced otherwise than as specifically set forth herein.

I claim:

1. A fire protection system for homes and other structures, comprising:

a plurality of enclosures, each housing a fire-resistant inflatable structure, wherein each said enclosure further comprises a bi-fold top panel having a centrally disposed pivoting hinge allowing for unfolding of said top panel, two side panels, a front panel, a plurality of centrally disposed handles attached to said enclosure, a plurality of wheels mounted to said enclosure, and a plurality of couplings mounted to said enclosure;

an air source;

a plurality of air hoses in fluid communication with said couplings and air source for administering pressurized air directly to said enclosure for deployment of said inflatable structure;

attaching means for connecting said fire-resistant inflatable structure; and a a plurality of tethers for securing said enclosures.

2. A fire protection system for homes and other structures according to claim 1, wherein said inflatable structure comprises a fire-resistant multi-layered shroud further comprising a plurality of rectangular panel shaped inflatable bladders having vertically oriented air baffles attached between said multiple layers of said bladders to form air channels therein, and wherein said shroud fixedly attaches to said front panel of said enclosure, further wherein said air baffles are in fluid communication with said couplings of said enclosure.

3. A fire protection system for homes and other structures according to claim 2, further comprising a fire-resistant sheet, wherein said sheet attaches to top of said shroud thereby providing a protective shield.

4. A method of utilizing a fire protection system for homes and other structures comprising the steps of:

providing an enclosure containing a fire-resistant inflatable fabric structure having a multi-layered protective shroud;

positioning said enclosure proximal to said home or other structure to be protected and between said home or other structure and a fire danger;

providing a source of pressurized air;

inflating the fabric structure of said fire-resistant shroud with said pressurized air thereby pushing said fire-resistant shroud out through a top panel of said enclosure;

attaching tethers when shroud is deployed so as to maintain proximity to said home or other structure to be protected;

evacuating said pressurized air from said inflatable fabric structure, thereby removing the protective shroud structural support and causing said shroud to settle on and envelop said home or other structure to be protected under the influence of gravity and said tethers;

reinflating the inflatable fabric structure so as to lift the shroud from said home or other structure to be protected after said fire danger has passed;

removing tethers;

evacuating said pressurized air in said inflatable fabric structure and causing said shroud to settle on the ground;

folding fabric shroud; and repacking fabric shroud in enclosure for reuse during next fire danger, and removing said enclosure from the proximal position.

5. The method of utilizing a fire protection system for homes and other structures of claim 4 wherein:

the step of providing an enclosure containing a fire-resistant inflatable fabric structure further comprises providing a plurality of enclosures each containing a fire-resistant inflatable fabric structure; and the step of positioning said enclosure further comprises positioning said plurality of enclosures in relative proximity to each other; and the method further comprises the step of tethering each fire-resistant inflatable fabric structure to an adjacent fire-resistant inflatable fabric structure.

* * * * *